US006435315B1

(12) United States Patent
Zaharia

(10) Patent No.: US 6,435,315 B1
(45) Date of Patent: Aug. 20, 2002

(54) ABSOLUTE POSITION REFERENCE SYSTEM FOR AN ELEVATOR

(75) Inventor: Vlad Zaharia, Rocky Hill, CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/734,508

(22) Filed: Dec. 11, 2000

(51) Int. Cl.[7] ..... B66B 3/02
(52) U.S. Cl. ..... 187/394
(58) Field of Search ..... 187/391, 393, 187/394, 312, 283

(56) References Cited

U.S. PATENT DOCUMENTS 3,963,098 A * 6/1976 Lewis et al. ..... 187/29
4,134,476 A * 1/1979 Zolnerovich et al. ..... 187/29 R
4,789,050 A * 12/1988 Evin ..... 187/134
5,023,434 A 6/1991 Lanfer et al.
5,135,081 A 8/1992 Watt et al.
5,509,505 A * 4/1996 Steger et al. ..... 187/394
5,821,477 A * 10/1998 Gerstenkorn ..... 187/394
5,889,239 A * 3/1999 Blackaby et al. ..... 187/391
6,082,498 A * 7/2000 Coste et al. ..... 187/284

* cited by examiner

*Primary Examiner*—Jonathan Salata
(74) *Attorney, Agent, or Firm*—Wall Marjama & Bilinski LLP

(57) ABSTRACT

Apparatus for determining the position of an elevator car within a hoistway that includes a code rail containing optically readable indicia that is being mounted within the hoistway adjacent to the path of travel of the car. At least one camera is mounted upon the car for movement therewith for scanning the code rail indicia and providing data indicative of the car's position to the car controllers.

31 Claims, 7 Drawing Sheets

| LANDING | P1Lx | P2Lx |
|---|---|---|
| 7 | 44.00 | – |
| 6 | 38.00 | 43.50 |
| 5 | 30.00 | 37.25 |
| 4 | 15.00 | 29.25 |

P1Lx – POSITION INDICATED BY READ HEAD 1 (P1) WHEN ELEVATOR IS AT LANDING x

P2Lx – POSITION INDICATED BY READ HEAD 2 (P2) WHEN ELEVATOR IS AT LANDING x

| LANDING | P1Lx | P2Lx |
|---|---|---|
| 7 | 44.00 | – |
| 6 | 38.00 | 43.50 |
| 5 | 30.00 | 37.25 |
| 4 | 15.00 | 29.75 |

P1Lx – POSITION INDICATED BY READ HEAD 1 (P1) WHEN ELEVATOR IS AT LANDING x

P2Lx – POSITION INDICATED BY READ HEAD 2 (P2) WHEN ELEVATOR IS AT LANDING x

ABSOLUTE POSITION REFERENCE SYSTEM FOR AN ELEVATOR

FIELD OF THE INVENTION

This invention relates generally to an elevator, and more specifically to method and apparatus for determining the position of an elevator car as the car moves along a hoistway.

BACKGROUND OF THE INVENTION

In order to bring an elevator car to a smooth, safe stop, level with a landing, the car controller must have reliable information concerning the movement and position of the car in order to know when to initiate car leveling and stop procedures as well as the opening the car doors. To carry out these functions accurately, it is necessary to know the car's exact position at all times.

Many existing reference systems are based on incremental encoders and vanes which can be mounted in a variety of arrangements within the hoistway. In one arrangement, an endless tape having slots formed along its length is attached to the car and is trained about idler sheaves located at the top and the bottom of the hoistway. One sheave contains teeth that mate with the slots in the tape so that the sheave is driven by the endless tape. An encoder is driven by the toothed sheave and provides primary car position information to the car controller. Additional discrete position sensors and vanes are located at each landing to provide secondary car position information that is used to bring the car to a smooth, safe stop at each landing.

A second widely employed position determining system involves an encoder that is mounted upon the shaft of the elevator drive motor. Car position data is determined by the encoder unite and is processed and used to derive the car speed and the distance to a landing information concerning the various floors. Additional sensors and vanes are again needed at each landing and the position of the elevator car as derived by the encoder is checked and corrected if needed each time the car passes a vane at a landing.

Although these existing systems work well in practice, they have certain drawbacks in that most prior art systems of this type are relatively expensive to install, and are difficult to adjust and costly to maintain. Error correction is also necessary at each landing in order to compensate for rope slippage or the like. The car's position relative to the landings is generally measured indirectly by an encoder and the position information is acquired incrementally. This data, therefore, must be saved in memory in case of a system shutdown. This, in turn, requires the use of batteries to power the memory during a shutdown. When position data is lost, correction runs must be carried out to reestablish position references and the system must be recalibrated often as the building housing the elevator system settles. Finally, as noted above, most prior art position reference systems require redundant position sensors and vanes at the landings to insure positive detection of the car, as it approaches the landings.

SUMMARY OF THE INVENTION

It is therefore an object of the present invention to improve elevators, and, in particular, to improve positioning systems used to control elevators.

It is a further object to provide a non-contact absolute positioning system for an elevator that will not be adversely affected by side-to-side or front-to-back movement of the elevator car.

A still further object of the present invention is to eliminate the need for correction runs and recalibration of an elevator position system after a power loss.

Another object of the present invention is to reduce the cost of installing and maintaining an elevator system.

Yet another object of the present invention is to provide a redundant speed measuring system for an elevator without the need of providing additional encoders.

Yet a further object of the present invention is to continually correct an elevator positioning system as a building in which the system is housed settles.

These and other objects of the present invention is attained by a system for determining the position of an elevator car within a hoistway in which the elevator car is mounted for reciprocal movement. In one form of the invention, a vertically disposed code rail containing optically discernable information is mounted within the hoistway adjacent to the car's path of travel. An optical sensor is mounted upon the car for movement therewith. The sensor is positioned to optically read code rail indicia related to the hoistway and feed this information to the car controller. The code rail can be a continuous strip running along the vertical length of the hoistway or code rail indicia on independent code rail sections, each of which being located at a particular landing.

In another form of the invention, a single sensor is arranged to read a code rail strip extending along the length of the hoistway to acquire primary position data and at the same time, read individual code rail sections at each landing to acquire secondary position data.

In a further embodiment of the invention, two sensors are secured to the elevator car in vertical spaced apart alignment and arranged to read two vertically separated code rail sections simultaneously to acquire a range of position related information.

BRIEF DESCRIPTION OF THE DRAWING

For a further understanding of these and other objects of the present invention, reference will be made to the following detailed description of the invention which is to be read in connection with the accompanying drawing, wherein.

DETAILED DESCRIPTION OF THE INVENTION

Figure 1:
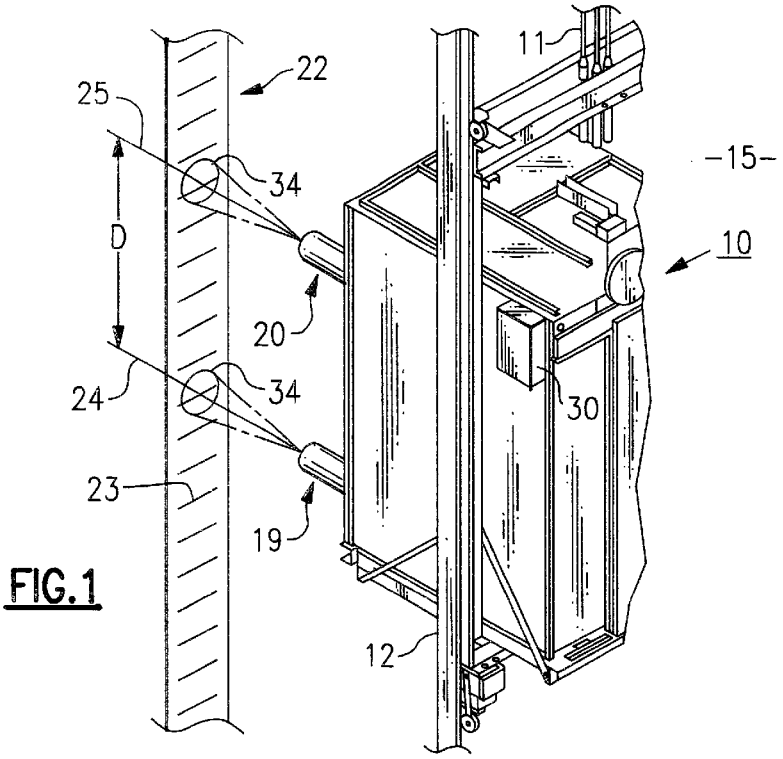
FIG. 1 is a perspective view of an elevator system embodying the teachings of the present invention.

Turning initially to FIG. 1, there is shown an elevator car, generally referenced 10, that is suspended by rope 11 between a pair of guide rails, one of which is depicted at 12. As is well known in the art, the car is arranged to move reciprocally over a vertical path of travel within a hoistway 15 that is housed within a structure having several floors. The car is equipped with a controller 30 which contains a processor that is programmed to carry out a number of car related control functions and a memory for storing position related data. To perform these and other control functions accurately, it is necessary that the processor receives accurate and sufficient information so that it is able to determine the car's exact location at all times within the hoistway. As will be described in greater detail below, the present invention employs one or two non contact sensors to acquire data for determining the car's position within the hoistway at all times and conveys this information to the elevator controller where it can be processed and utilized in carrying out various related control functions. As will further be explained in greater detail below, the sensor may be an optical device such as a CCD or CMOS equipped camera or an LED equipped reader for reading spaced apertures in a coded strip. Other forms of readers are also contemplated for use in the practice of the present invention such as infrared sensors or the like.

The car, in one embodiment of the invention, is equipped with a pair of cameras that include a lower camera 19 and an upper camera 20 that are focused upon a series of adjacent code rail strip 22 so that the cameras can record images of indicia 23 carried upon the strip. The two cameras are spaced apart so that the center axis 24 and 25 of the cameras are located at a fixed vertical distance D from one another. Accordingly, each camera scans a different area of the code rail strip as the car moves over its vertical path of travel. Although two cameras are employed in this embodiment of the invention, it will become evident from the disclosure below that one camera can be utilized in a further embodiment of the invention without departing from the teachings of the present invention.

Figure 2:
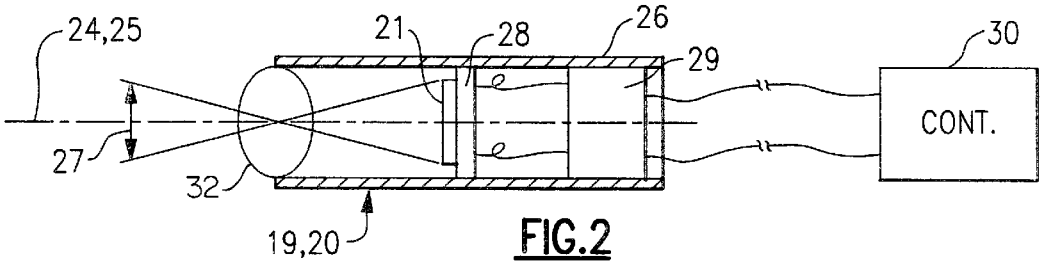
FIG. 2 is an enlarged side elevation in section showing a CCD equipped camera suitable for use in the practice of the present invention.
Figure 3:
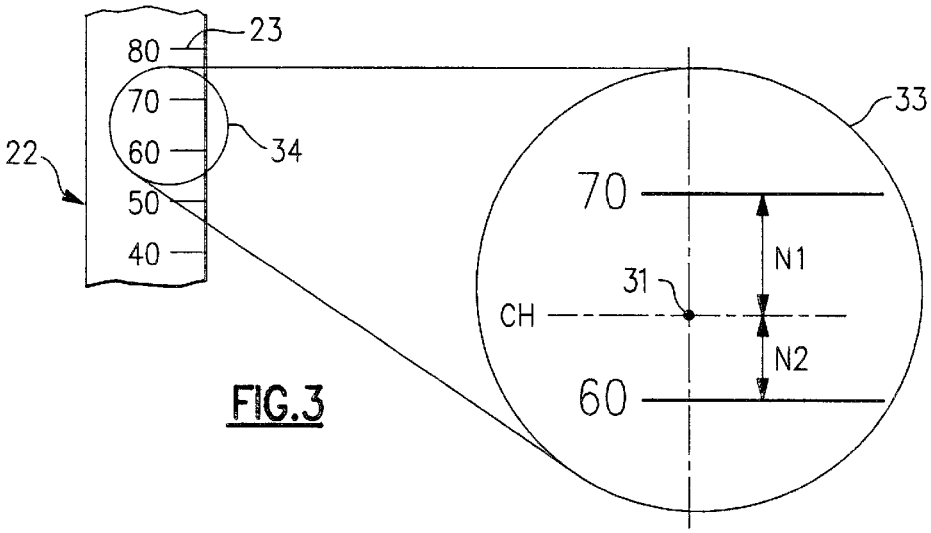
FIG. 3 is an enlarged view showing the image of the code rail that is projected onto a camera's CCD imager.

As further illustrated in FIGS. 2 and 3, the cameras 19 and 20 are both of similar construction and include a charge couple device (CCD) 21 for recording scanned images of the code rail strip. Each camera contains a lens or lens system 32 located at the distal end of the camera housing 26 for focusing an image of a code rail target 34 that surrounds the center axis of each camera upon the CCD imager. The CCD imager is mounted within the housing upon a substrate 28 along with the imager support circuitry. The image data from the imagers are fed to a signal amplifier 29 and is then forwarded to the cab controller 30 where the position data is processed and utilized in various related elevator control functions. Some of the data may also be stored in memory and periodically updated as necessary.

FIG. 3 illustrates a section of a code rail strip 22 in which each indicia is given a specific number with the indicia value increasing in an upward direction. The division or space between adjacent numbers is of equal distance along the length of the hoistway section. Although the divisions may be of any desired value, the division numbers are given in centimeters in the present example. The enlarged image of the scan area 34 that is recorded upon the CCD imager is depicted at 33 with the center axis 24, 25 of the camera being shown at point 36 where the vertical and horizontal diameters intersect. In this example, the axis of the camera is focused at a point somewhere between the upper position number which is 70 centimeters and the lower position number which is 60 centimeters. The camera, in association with the controller, optically identifies the upper and lower division number using well known optical character recognition techniques. The CCD imager contains a large number of pixels that are arranged in a raster pattern of horizontal rows and vertical columns. The position of the camera axis with respect to the code rail is now determined by counting the number of pixel rows separating the axis of the camera from the upper and lower division numbers which, in this example, is 237 pixel rows from the upper division marker and 198 pixel rows from the lower division number. Applying the following relationship:

$$ABSPOS = LOWPOS + N2 \cdot (HIGHPOS - LOWPOS)/(N1 + N2) \quad (1)$$

where:

ABSPOS is the position of the camera axis

LOWPOS is the lower division number

HIGHPOS is the high division number

N1 is the number of pixel rows separating the camera axis and the upper division number, and N2 is the number of pixel rows separating the camera axis and the lower division number.

Solving the relationship for this example:

$$ABSPOS = 60 + 198 \cdot (70 - 60)/(237 + 198) = 64.55 \text{ cm}$$

The location of the camera axis is at a vertical location of 64.55 cm above the lower datum plane of the code rail strip.

In this embodiment, each camera takes a picture of the tape at predetermined intervals as for example 5.0 milliseconds. Based on the position of the camera relative to the numbered indicia on the strip, the camera image determines the position of the elevator in the hoistway using both optical character recognition and pixel counting. The code rail may be a continuous strip as shown, or can consist of a series of individual code rail sections that are applied directly to the door frames at each landing or any other fixed position relative to each of the landings. The cameras are positioned so that at least one camera sees at least one of the code rail sections at all times. This arrangement allows for on the fly generation of a continuous position reference.

As should be evident front to rear or side to side motion of the car will not adversely effect the measurements provided that the camera can see both the high and low divisions and their associated numbers because the term ABSPOS is dependent upon the ratio of N1/N2.

A fully redundant position references system can also be implemented using two vertically spaced cameras 19 and 20 separated a distance D, as illustrated in FIG. 1. As further illustrated in FIG. 4, in this embodiment of the invention a vertical series of individual code rail sections 35–38 are utilized, with each individual section being located at one of the landings. Each section contains a series of indicia markers 39 which are spaced 0.25 m apart. The code rail sections are each separated by a gap distance (d) as shown between code rail sections 35 and 36. The gap distances can be equal or unequal provided each gap distance is less than the vertical separation (D) between the cameras. The code rail sections are encoded as shown with numerals, each of which indicates a position within the hoistway. Although the numbers represent absolute distances from a given reference point, it should be evident to one skilled in the art that the numbers may represent any value that will enable the elevator controller to determine the exact car position within the hoistway in a unique, non-repetitive manner. Code rail sections may also be mounted in express zones that do not have landings, provided that the gap between the sections remains less than the vertical distance between the cameras. Although at times a first camera may be traveling in the gap zone between code rail sections, the second camera is providing data to the controller. The position of the first camera, however, in relation to the second camera is always ascertainable by the controller because the first camera will remain a given distance (D) from the second camera. As should now be evident, the system utilizes discrete code rail sections to provide continuous absolute positioning data to the car controller.

Figure 4:
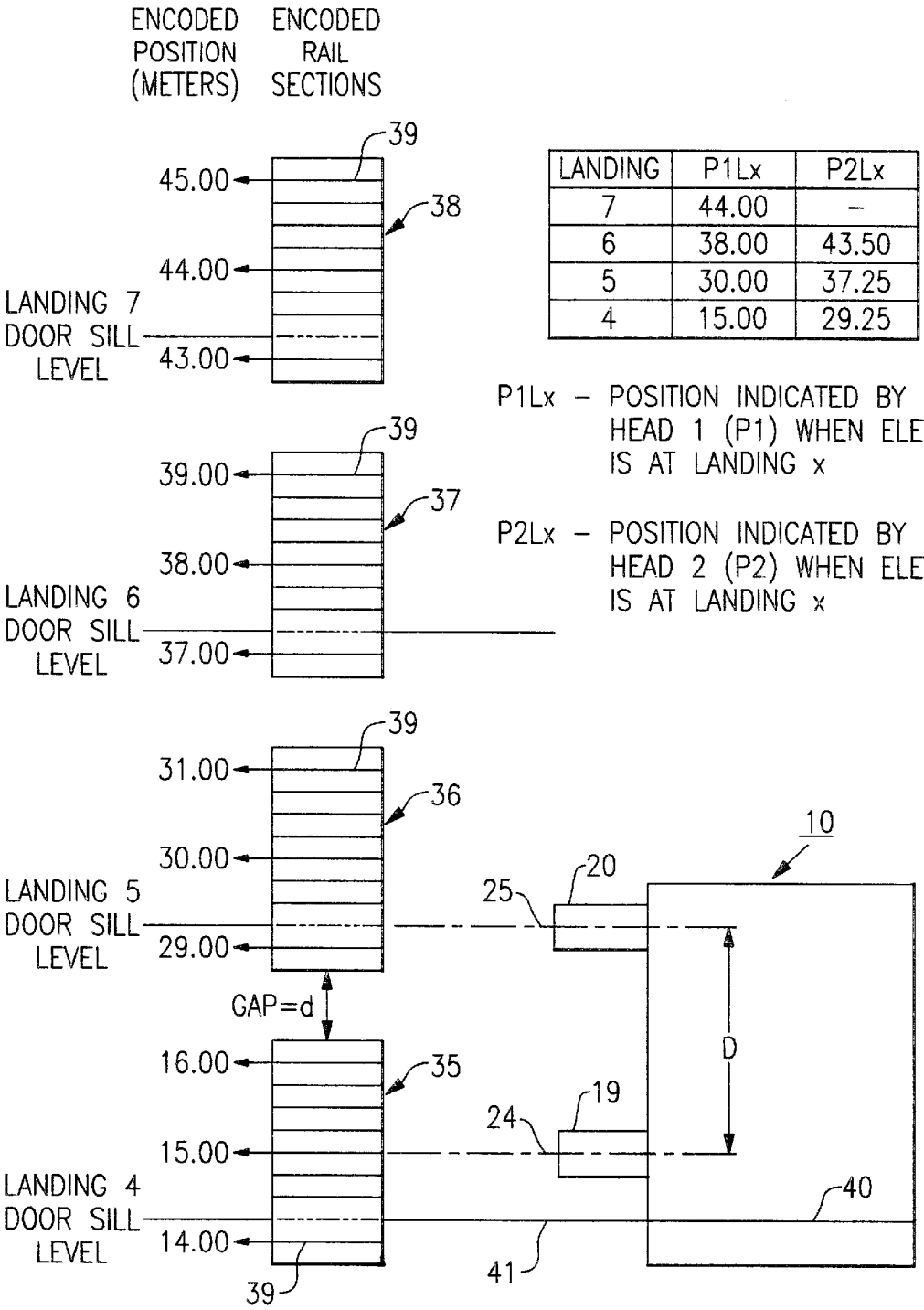
FIG. 4 illustrates a further embodiment of the invention wherein a pair of vertically aligned cameras are mounted upon the elevator car so that each camera can view a separate code rail sections mounted upon the door frames of adjacent landings.

An elevator car 10 is shown in FIG. 4 with the car platform 40 being level with the door sill 41 at landing 4. The lower camera 19 at this time is positioned to read data on the code rail section 35 which is mounted upon the door frame, of the landing 4 with the reading being taken along the axis 24 of the camera at 15.00 meters. The central axis 25 of the upper camera 20 is spaced vertically a distance D from that of the lower camera. At this time, when the elevator car platform is level with the sill at landing 4, the axis of the upper camera is reading division marker 29.25 meters of code rail section 36 which is mounted upon the door frame of the next higher landing which is landing 5. The table associated with FIG. 4 shows the division markers that are read by the two cameras at the various floors when the car platform is level with the landing door sills at floors 4–7. This data can be placed in the memory of controller 30 for use in carrying out a number of position related functions. Although the division between the markers is given in 0.25 meters, there does not have to be any correlation between these markers and the actual positions of landings relative to each other.

Figure 5:
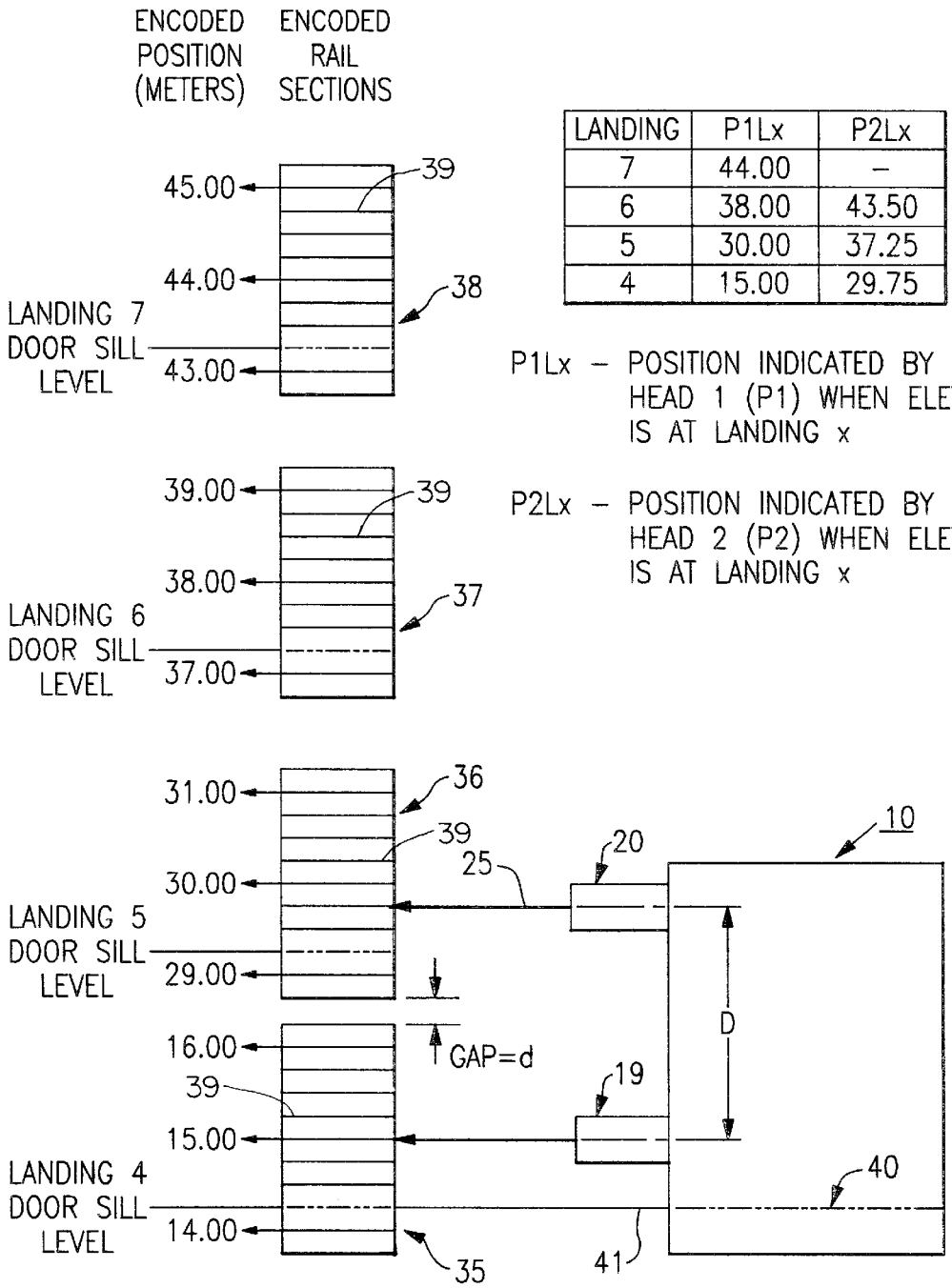
FIG. 5 is a view similar to FIG. 4 further illustrating how the two-camera system can be used to find the relative positions of two adjacent code rail sections once the building has settled.

FIG. 5 shows the same landing and code arrangement as explained above with regard to FIG. 4, however, the positioning of the landing relative to each other has now changed because the building in which the elevator is housed has settled somewhat between landings 4 and 5. The car platform 40 is again shown level with the door sill 41 at landing 4 and still reads 15.00. However, landing 5, at this time, has sagged slightly and the upper camera now reads 29.75, clearly showing that the distance between the code rail sections located at landings 4 and 5 has been shortened by 0.5 meters. The table associated with FIG. 5 shows the change in camera reading resulting from the building sagging between landings 4 and 5. The distance between the remaining floors, however, remains unchanged in the present example. The processor memory is updated with this new information.

Figure 6:
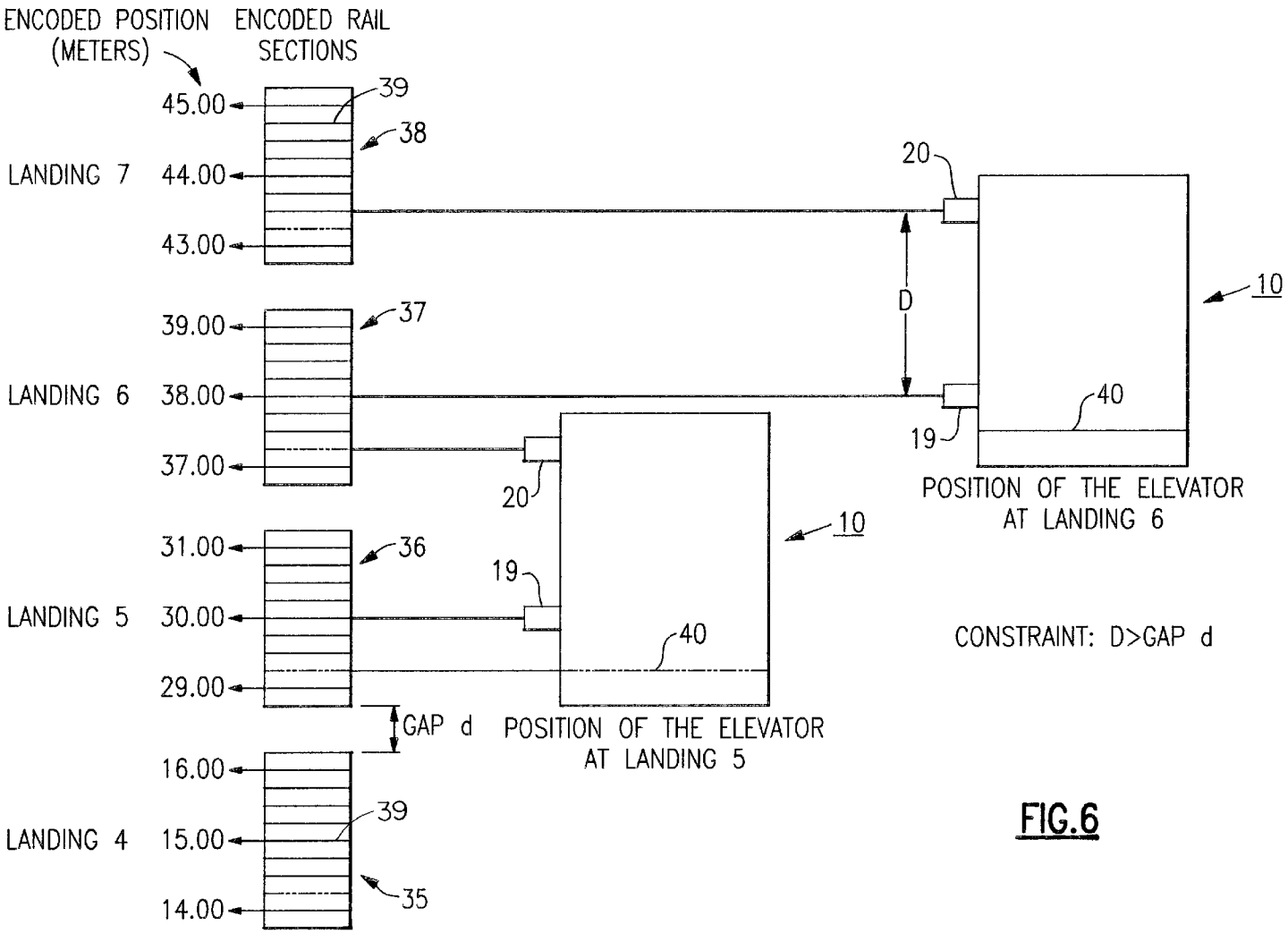
FIG. 6 is a view similar to FIG. 4 illustrating how the relative distance between adjacent landings and between all landings can be calculated using information acquired by the present two camera system.

FIG. 6 illustrates how the relative distance between adjacent landings can be calculated using the two camera system described above to provide corrected data to the elevator control system so that it can carry out the various car functions relating to motion control. In the example shown in FIG. 6, the initial position between landings 5 and 6 as illustrated in FIG. 5 can be found by the following relationship:

$$\text{DIS.}=P1L6-P2L5+D \tag{2}$$

where:

DIS is the distance between adjacent landings.

P1L6 is the reading along the axis of camera 19 when the elevator platform is level with the sill at landing 6.

P2L5 is the position of camera 20 when the elevator platform is level with the landing sill at landing 5, and D is the vertical spacing between cameras which in this example is 2.5 meters.

Prior to the building settling, the distance between landing as taken form the table in FIG. 4 was:

$$\text{DIS}=38.00-37.25+2.50=3.25\text{ m}$$

After the building has settled, as described with reference to FIG. 5, the distance between landings 5 and 6, as taken from the table in FIG. 5 is now:

$$\text{DIS}=38.00-37.50+2.50=3.00\text{ m}$$

The key to the above is that P1L6 and P2L5 are both determined by reading the same code rail section which in this case, is the code rail section at landing 6. As noted above, it should now be obvious that the absolute marker readings are unimportant. For example, in the case where the code rail section at landing 6 were encoded from 93.00 m and 95.0 meters, the calculated distance between landings 5 and 6 will remain the same as noted above.

$$P1L6-P2L5+D=94-93.50+2.50=3.00\text{ m}$$

Accordingly, motion control of the system will also be unaffected. This information is fed into the controlled processor, and the marker locations at each landing is corrected accordingly.

As should now be evident, the absolute code rail numbers at the various landings are unimportant providing the numbers are not repeated and the spacing between numerical markers is such that the upper and lower numbers are clearly identified so that the motion control based on the readings is not adversely effected.

It should be further noted that in some high rise applications express elevators may be employed wherein landings between certain floors are not used or are not contained within the hoistway. In this case, code rail sections can be mounted within the express zone of the hoistway to provide coded data to the processor that provides information telling the processor where the car is in reference to the express zone.

Figure 7:
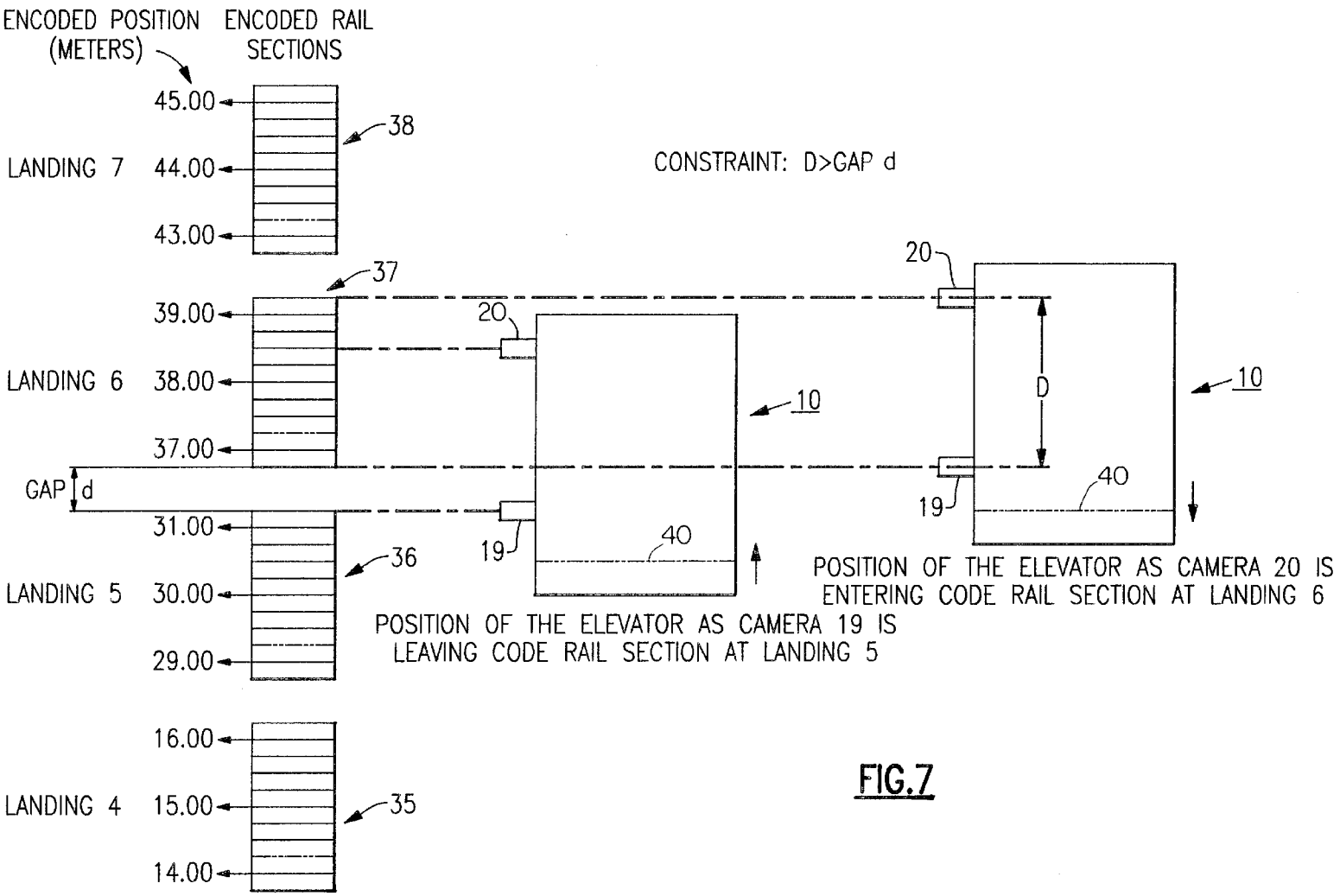
FIG. 7 is a view similar to FIG. 4 illustrating how the present two camera system can be used to calculate the gap between two adjacent code rail sections.

FIG. 7 illustrates how the two-camera system may be employed to calculate the gap between two adjacent code rail sections. This is an important parameter because the gap distance between code rail sections must always be less than the spacing D between cameras in the two camera embodiment of the invention. As illustrated, the gap between the adjacent code rail section at landings 5 and 6 can be determined by taking readings of code rail sections 36 and 37 as the elevator car moves first in an upward direction and then as the car returns moving in the opposite direction. As the car moves upward past landing 6, and the axis of the lower camera leaves the associated code rail section 36, a reading of the upper camera is taken to provide an indication of the lower gap reading which, in this case, is 38.50. A second reading is now taken as the car moves downwardly through the two landings. The second reading is taken by the upper camera 20 as the axis of the lower camera 19 leaves the code rail section 37 which, in this case is 39.25.

Subtracting the first reading from the second reading provides the gap distance between rail sections 36 and 37 which in this case, is 0.75 m. The gap distances can be continually monitored and, in the event a gap distance that approaches the spacing (D) between cameras and an alert is provided by the processor so that corrective action can be taken in a timely manner to insure that the gap distance does not exceed the (D) distance.

Figure 9:
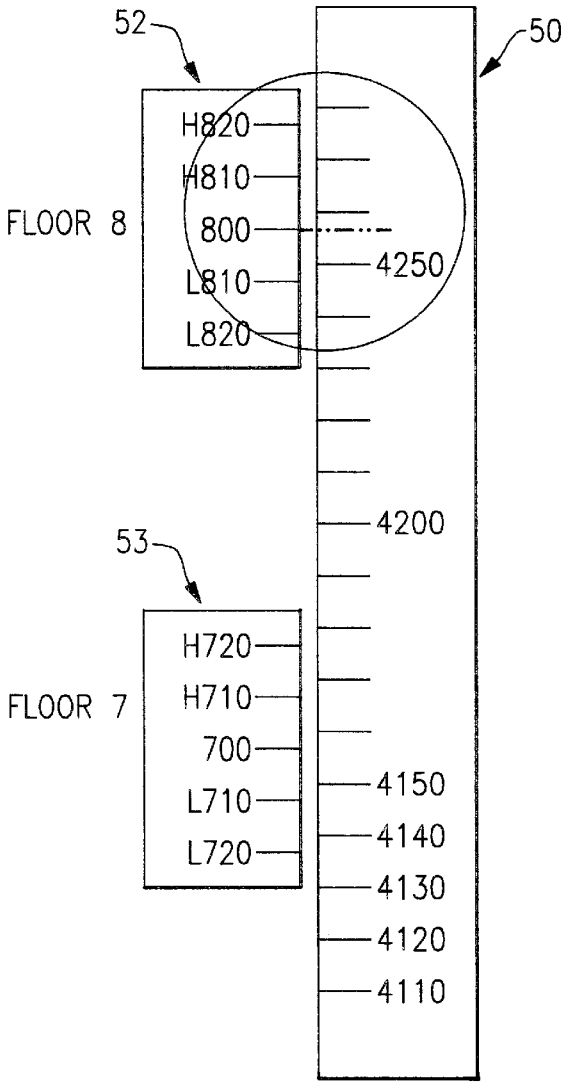
FIG. 9 is a further embodiment of the invention showing the use of a continuous code rail strip mounted in a side-by-side relationship with individual code rail sections that are located at adjacent landings and further illustrating the camera image of the code rail strip and a code rail section recorded by the image sensor.
Figure 8:
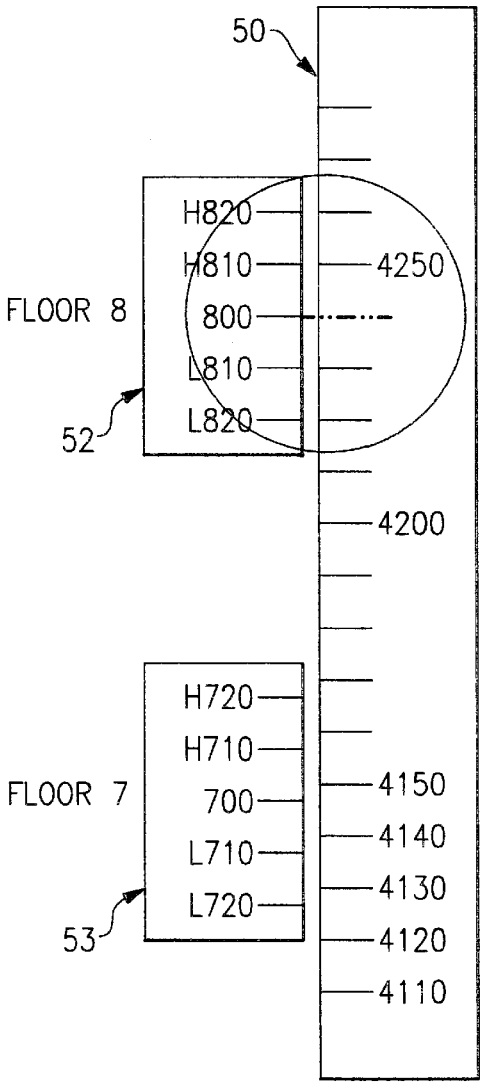
FIG. 8 is a view similar to that illustrated in FIG. 8 showing the camera image of the same landing after the building housing the elevator has settled.

Referring now to FIGS. 8 and 9, there is illustrated a further embodiment of the present invention wherein a single camera mounted upon the elevator car can be used to obtain both primary and secondary position data. In this embodiment, a continuous code rail strip 50 is vertically extended along the length of the hoistway. The strip is mounted close to each of the landings in the vicinity of the landing door frame. A series of code rail sections, such as sections 52 and 53, are mounted adjacent to and in parallel alignment with the code rail strip with a rail section being located at each landing so that a camera mounted on the elevator car can view indicia on both the code rail strip and a code rail section simultaneously. The code rail strip is used to provide primary position data to the controller and the code rail sections are used to provide secondary position data to the controller. The primary data relates to the position of the car within the hoistway while the secondary data relates to the position of the car in relation to one of the associated landing sites. The code rail sections are numbered so that the contained indicia identifies the floor and the location of the door sill. As the elevator car approaches a landing, the camera reads both code rails and provides both primary and secondary position data simultaneously to the controller.

FIG. 9 illustrates the relative positions of the primary and secondary indicia when the car platform is level with the door sill at landing 8. At this time the secondary reading is 800 and the primary position is 4257 cm. FIG. 8 illustrates the reading taken by the camera after the building has settled. At this time, the primary reading has changed to 4240 cm. As can be seen, using a single camera to view both the code rail strip and the code rail sections, a stream of data can be continually provided to the controller as the elevator car moves along the hoistway which can be used to determine the absolute position of the car within the hoistway as well as providing correction data to the controller in the event the building sags between floors.

Figure 10:
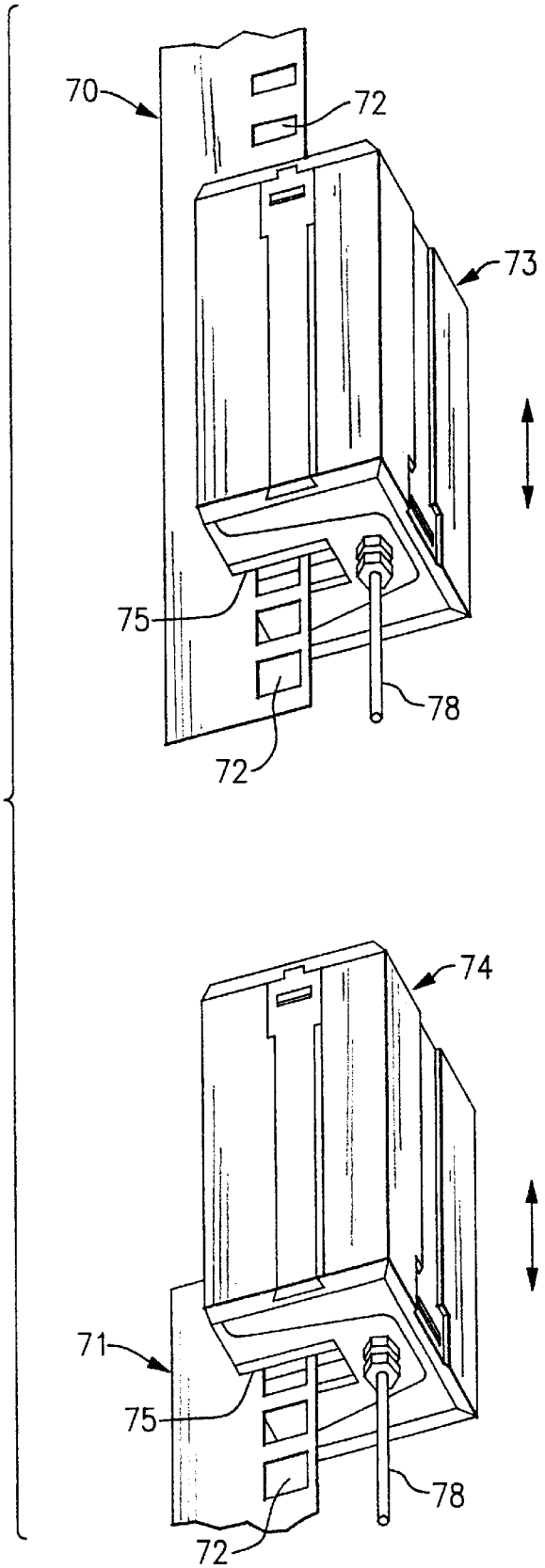
FIG. 10 is a partial view in perspective illustrating a further embodiment of the invention.

Referring now to FIG. 10, there is illustrated a further embodiment of the invention wherein individual code rail sections 70 and 71 are vertically mounted at intervals along the hoistway. Each code rail section contains position related data thereon in the form of clear apertures 72. Preferably, each individual section is mounted adjacent the car's path of travel upon or near the door frame at each landing or any other convenient place within the landing zone. In case there exists an express region within the hoistway, that has no landings, the sections are positioned at given intervals along the express region and again contain data relating to the cars position as it moves through the express region.

In this embodiment, a pair of read heads 73 and 74 are mounted upon the car at a vertical separation distance (D) that is greater than the gap (d) between each adjacent code rail section. Each read head contains a light tight slot 75 with the slots being vertically aligned so that the code rail sections can be drawn through each read head as the car moves through the hoistway. Although not shown, an array of light emitting diodes are mounted along one side of the slot in each read head and an array of light detectors are mounted along the opposite side of the slot to sense the light emitted by the diodes. As a code rail is drawn through the housing, the light from the diode array is chopped by the strip in a coded fashion to provide nonrepeatable positioning data to the detectors which, in turn, supply this data to the car controller via data lines 78. Read heads of the type herein described are commercially available from R. Stahl Foerdertecnik, Gmbh of Künzelsau, Germany.

As should now be evident, this embodiment of the invention again employs two discrete sensors to provide continuous absolute positioning data to the car controller.

While the present invention has been particularly shown and described with reference to the preferred mode as illustrated in the drawing, it will be understood by one skilled in the art that various changes in detail may be effected therein without departing from the spirit and scope of the invention as defined by the claims.

I claim:

1. Apparatus for determining the position of an elevator car within a hoistway that includes:

an elevator car mounted for reciprocal movement along a vertical path of travel within a hoistway between a series of landings, a code rail strip containing optically discernable position related indicia, said code rail being stationarily mounted within the hoistway adjacent to the car's vertical path of travel, a sensor mounted upon said elevator for movement therewith, said sensor being positioned to scan the code rail to read said indicia indicative of the car's position in said hoistway and providing output signals relating to said indicia, a car controller for receiving said output signal from said sensor and carrying out car related functions in response thereto, and a code rail section mounted in each landing, adjacent said code rail strip, and containing indicia relating to its associated landing, said sensor being arranged to read data contained on two adjacent code rail sections simultaneously.

2. The apparatus of claim 1 wherein said indicia includes markers that are spaced along the code rail strip and said markers being identified by optically readable characters and the divisions between characters being spaced along the length of said strip.

3. The apparatus of claim 2 wherein said sensor is equipped with an imager containing pixels aligned in horizontal rows.

4. The apparatus of claim 3 wherein the sensor is a camera having a CCD or CMOS imager.

5. The apparatus of claim 3 wherein the sensor provides optical recognized data to the controller relating to the markers recorded by the imager and pixel data relating to the position of the optical axis of the sensor with reference to the recorded markers whereby the absolute position of the sensor within the hoistway can be accurately determined.

6. The apparatus of claim 1 wherein said code rail sections are mounted upon an elevator door frame at each landing.

7. Apparatus for determining the position of an elevator car within a hoistway that has a series of vertically aligned landings, said apparatus including:

vertically disposed code rail sections mounted at specific locations relative to the elevator car's path of travel along said hoistway, each code rail section containing optically readable indicia relating to an associated location, and adjacent code rail sections being separated by a gap (d), a first lower sensor mounted upon said elevator car so that said sensor can read said code rail sections as the car moves along the hoistway, and a second upper sensor mounted at a predetermined vertical distance (D) above the lower sensor on said car so that the upper sensor can read the code rail sections as the car moves along the hoistway, the vertical distance (D) between the sensors being greater than the gap distance (d) between adjacent code rail sections such that the two sensors are capable of reading two adjacent vertically disposed code rail sections simultaneously, each sensor containing an output means for providing recorded code rail data to a car controller having a processor for determining the car's position within the hoistway.

8. The apparatus of claim 7 wherein said indicia includes markers that are spaced apart along each code rail section, the markers being located at specific distances along the length of each code rail section and each marker containing optically recognizable numerals.

9. The apparatus of claim 8 wherein each sensor is a camera that is capable of reading indicia recorded upon the code rail sections, each camera being equipped with an imager containing pixels that are aligned in horizontal rows.

10. The apparatus of claim 9 wherein each camera provides output signals to the controller relating to the markers recorded upon said imager and pixel information relating to location of the optical axis of the camera in relation to the recorded markers.

11. The apparatus of claim 10 wherein each code rail section is mounted upon a door frame within each landing and at specific intervals within express zones along the hoistway.

12. A method of determining the position of an elevator car within a hoistway that includes the steps of:

mounting a code rail strip within the hoistway that extends along the length of said hoistway, placing optically readable indicia upon the code rail strip for identifying vertically spaced locations along the hoistway, mounting an optical sensor upon the elevator car in a position for optically reading location related indicia contained upon the code rail, forwarding position related data from the optical reader to a car controller having a processor for carrying out various car related functions relating to the position data and placing a code rail section adjacent to said code rail strip at each car landing so that the reader can simultaneously read indicia on adjacent code rail sections.

13. The method of claim 12 that includes the further step of placing spaced apart markers along the length of the code rail strip that are indicative of landings along the hoistway.

14. The method of claim 13 wherein the sensor is a camera containing a CCD imager for optically reading the markers contained on the code rail strip, said imager having a number of horizontally disposed rows of pixels.

15. The method of claim 14 that includes the further step of scanning the code rail strip to identify the successive markers on the code rail through optical recognition and counting the number of rows of pixels between the optical axis of the imager and the upper and lower markers and determining the absolute position of the car by the relationship:

$$ABSPOS=LOWPOS+N2\cdot(HIGHPOS-LOWPOS)/(N1+N2)$$

where:

ABSPOS is the absolute position of the car

LOWPOS is the low division number

HIGHPOS is the high division number

N1 is the number of pixel rows between the center of the imager and the low division number, and N2 is the number of pixel rows between the center of the imager and the high division number.

16. The method of claim 14 including the step of employing the data acquired from the code rail strip to determine primary positioning information relating to the car's position with respect to the hoistway and using the data acquired from the code rail sections to determine secondary positioning information relating to the car's position with respect to a landing.

17. A method of determining the position of an elevator car within a hoistway housed within a building, said hoistway having a series of vertically disposed landings, each containing a door frame, said method including the steps of:

mounting individual vertically disposed code rail sections at each landing so that a gap is initially maintained between adjacent code rail sections, placing optically readable indicia markers upon each code rail section that is indicative of the car's position relative to an adjacent landing, mounting a first lower sensor and a second upper sensor in spaced vertical alignment on said car, the space between sensors being greater than the gap between adjacent code rail sections, and providing position related data from said sensor to a processor in the car controller whereby various position related functions can be carried out.

18. The method of claim 17 that includes the further step of spacing the indicia marker at specific intervals on each code rail section.

19. The method of claim 18 that includes the further step of placing scanned marker location data in the memory within the processor.

20. The method of claim 19 including the further step of updating the marker readings stored in memory to determine changes in the location of the code rail sections in the event the building settles.

21. The method of claim 20 that includes the further step of determining the relative distance between the adjacent landing sills by calculating the initial distance between two adjacent landing sills using the stored camera data, periodically recalculating the distance between the two adjacent sills using updated stored camera data, and comparing the calculated and recalculated data to determine any difference between the calculated and recalculated data.

22. The method of claim 20 wherein the distance between adjacent landing sills is calculated using the relationship:

$$DIS=P1LX-P2LY+D$$

where:

DIS is the vertical distance between sills

P1LX is the marker position of the axis of the lower camera when the car platform is level with the sill at landing where x is the upper of the two adjacent floors, P2LY is the marker position of the axis of the upper camera when the car platform is level with the sill of landing y, where y is the lower of the two adjacent floors, and D is the vertical distance between the axes of the two cameras.

23. The method of claim 17 that includes the further step of moving the car upwardly in the hoistway, noting when the first lower sensor leaves a first code rail section and taking at that time a first reading of a marker on a second adjacent code rail section with the second upper sensor, moving the car downwardly in the hoistway, noting when the upper sensor leaves the second code rail section and taking at that time a second reading of a marker on the first code rail section with the lower sensor, subtracting the first reading from the second reading to determine the gap between the code rail sections, and providing an alert signal in the event the gap distance approaches the fixed vertical distance between the cameras.

24. The method of claim 16 that includes the further step of activating the cameras in an ordered sequence.

25. A method of determining the position of an elevator in a building housing a hoistway having a series of vertically aligned landings, each of which contains a door frame, said method including the following steps of mounting a continuous code rail strip vertically along the length of the hoistway adjacent to the path of travel of said car, placing optically readable primary indicia markers upon the strip that are indicative of the car's position within the hoistway, mounting discrete vertically disposed code rail sections at each landing adjacent to the continuous code rail strip, placing optically readable secondary indicia markers on each code rail section that are indicative of the car's positions relative to each landing.

mounting a single sensor upon the car capable of simultaneously reading the code rail strip and the individual code rail sections as the car moves along the hoistway, and providing primary and secondary position data from the optical reader to a car controller whereby various car related functions can be controlled.

26. The method of claim 25 that includes the further step of spacing the indicia marker at specific distances along the code rail strip and upon each code rail section.

27. The method of claim 25 that includes the further step of storing the sensor reading in the memory of the car controller.

28. The method of claim 27 that includes the further step of periodically updating the data stored in memory.

29. Apparatus for determining the position of an elevator within a hoistway that includes an elevator car mounted for reciprocal movement along a vertical path of travel within a hoistway, vertically disposed code rail sections mounted at specific locations relative to the elevator car's path of travel, each code rial section containing a series of apertures formed therein relating to an associated location, adjacent code rail sections being separated by a gap (d), a first read head mounted upon said car having a vertically disposed slot formed therein for receiving the code rail sections as the car moves through said specific locations, a second read head mounted upon said car a given vertical distance (D) above said first read head, said second read head having vertically disposed slots formed therein for receiving the code rail sections as the car moves through said specific locations, said vertical distance (D) being greater than the gap distance (d) such that the read heads are capable of reading two adjacent vertically disposed code rail sections, simultaneously, and each read head containing an array of light emitting diodes on one side of said slot and an array of light detectors on the opposite side of said slot for reading the data on said code rail sections and providing output signals to the car controller indicative of the car's position within said hoistway.

30. The apparatus of claim 29 wherein a code rail section is mounted at each landing along the hoistway.

31. The apparatus of claim 29 wherein code rail sections are mounted within express zones along the hoistway.

* * * * *